US011382369B2

(12) United States Patent
Hampton

(10) Patent No.: US 11,382,369 B2
(45) Date of Patent: Jul. 12, 2022

(54) HELMET AND SHOULDER PAD ASSEMBLY

(71) Applicant: David Hampton, Indianapolis, IN (US)

(72) Inventor: David Hampton, Indianapolis, IN (US)

( * ) Notice: Subject to any disclaimer, the term of this patent is extended or adjusted under 35 U.S.C. 154(b) by 127 days.

(21) Appl. No.: 16/896,966

(22) Filed: Jun. 9, 2020

(65) Prior Publication Data

US 2021/0378322 A1 Dec. 9, 2021

(51) Int. Cl.

| | |
|---|---|
| ***A41D 13/05*** | (2006.01) |
| ***A42B 3/20*** | (2006.01) |
| ***A63B 71/12*** | (2006.01) |

(52) U.S. Cl.

CPC ..... *A41D 13/0512* (2013.01); *A42B 3/20* (2013.01); *A63B 71/12* (2013.01)

(58) Field of Classification Search

CPC ..... A41D 13/0512; A42B 3/20; A63B 71/12
See application file for complete search history.

(56) References Cited

U.S. PATENT DOCUMENTS

| | | | | |
|---|---|---|---|---|
| 3,134,106 | A * | 5/1964 | Shaffer | A42B 3/0473 2/462 |
| 4,825,476 | A * | 5/1989 | Andrews | A42B 3/0473 2/421 |
| 5,444,870 | A | 8/1995 | Pinsen | |
| 6,385,781 | B1 | 5/2002 | Rose | |
| 6,874,170 | B1 * | 4/2005 | Aaron | A41D 13/0512 2/468 |
| 6,968,576 | B2 * | 11/2005 | McNeil | A42B 3/0473 2/425 |
| 7,120,941 | B2 * | 10/2006 | Glaser | A42B 3/0473 2/424 |
| 8,561,217 | B2 | 10/2013 | Nagely | |
| 8,621,672 | B2 | 1/2014 | Chuback | |
| 9,205,320 | B2 * | 12/2015 | Mason | A41D 13/015 |
| D752,823 | S | 3/2016 | Bologna | |
| 2004/0194194 | A1 * | 10/2004 | McNeil | A63B 71/10 2/421 |
| 2014/0237707 | A1 | 8/2014 | Lane | |
| 2016/0338440 | A1 | 11/2016 | Popejoy | |
| 2019/0344152 | A1 * | 11/2019 | Popejoy | A41D 13/0512 |
| 2020/0163400 | A1 * | 5/2020 | Salaam | A42B 3/105 |

* cited by examiner

*Primary Examiner* — Tajash D Patel

(57) ABSTRACT

A helmet and shoulder pad assembly for protecting a user from a concussion injury includes a pair of shoulder pads that is wearable on a user's shoulders during athletic activity. A helmet is hingedly coupled to the shoulder pads and the helmet is positionable in a closed position to cover the user's head. The helmet is coupled to the shoulder pads when the helmet is positioned in the closed position thereby facilitating the helmet to transfer impact energy into the shoulder pads. In this way the helmet inhibits the user from suffering a concussion injury. The helmet is positionable in an open position to expose the user's head.

8 Claims, 4 Drawing Sheets

HELMET AND SHOULDER PAD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to helmet devices and more particularly pertains to a new helmet device for protecting a user from a concussion injury.

(2) Description of Related Art Including Information Disclosed Under 37 CFR 1.97 and 1.98

The prior art relates to helmet devices including a helmet and shoulder pad assembly that includes a helmet that is rotatably and pivotably coupled to a pair of shoulder pads. The prior art discloses a shock absorbing device that is coupled between a helmet and a pair of shoulder pads for absorbing impact energy. The prior art also discloses a helmet that includes a restraint harness for limiting motion of the helmet on a user. The prior art also discloses a helmet that is coupled to a body harness for transferring impact energy on the helmet into the body harness.

BRIEF SUMMARY OF THE INVENTION

An embodiment of the disclosure meets the needs presented above by generally comprising a pair of shoulder pads that is wearable on a user's shoulders during athletic activity. A helmet is hingedly coupled to the shoulder pads and the helmet is positionable in a closed position to cover the user's head. The helmet is coupled to the shoulder pads when the helmet is positioned in the closed position thereby facilitating the helmet to transfer impact energy into the shoulder pads. In this way the helmet inhibits the user from suffering a concussion injury. The helmet is positionable in an open position to expose the user's head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
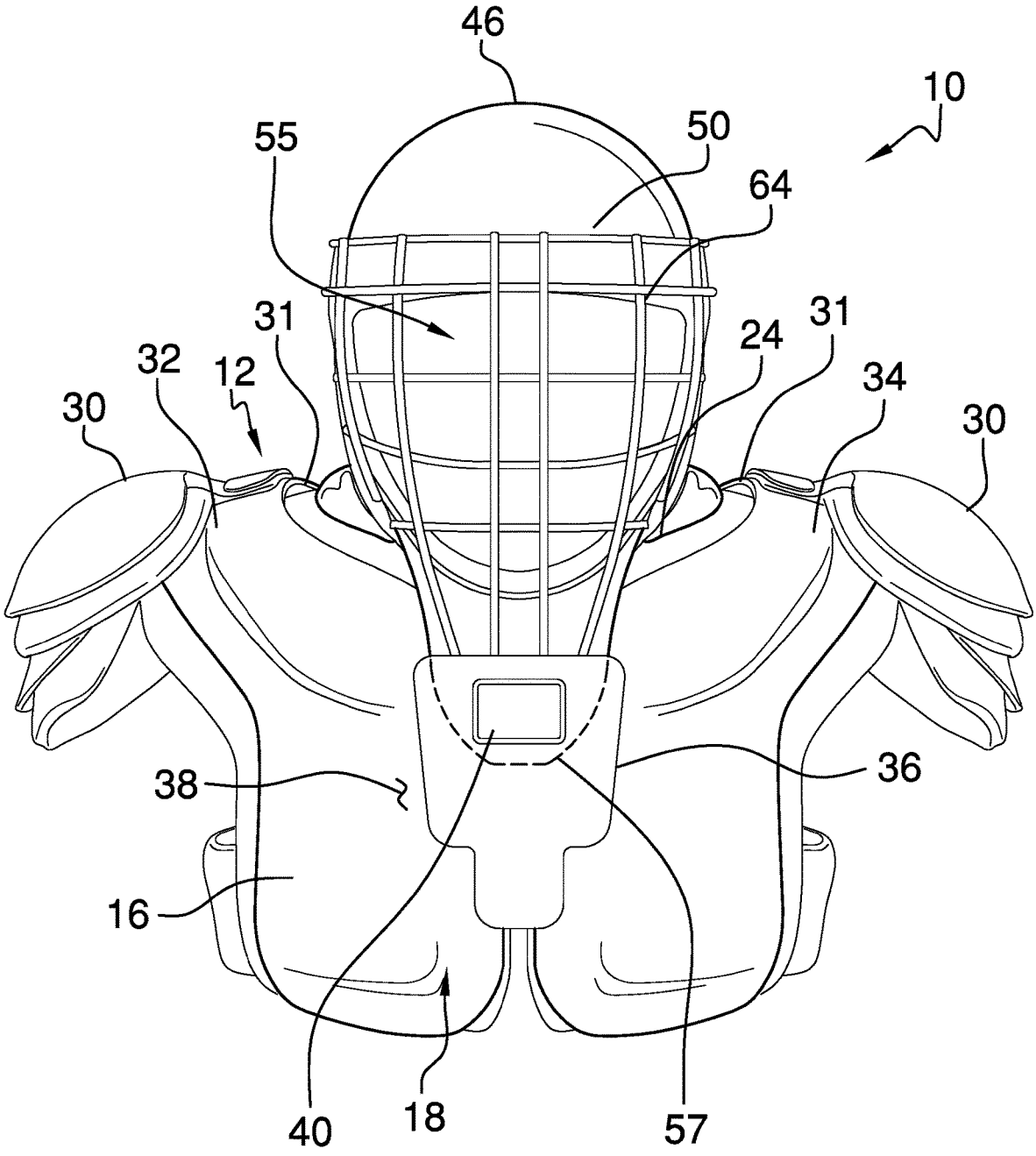
FIG. 1 is a front view of a helmet and shoulder pad assembly according to an embodiment of the disclosure.
Figure 2:
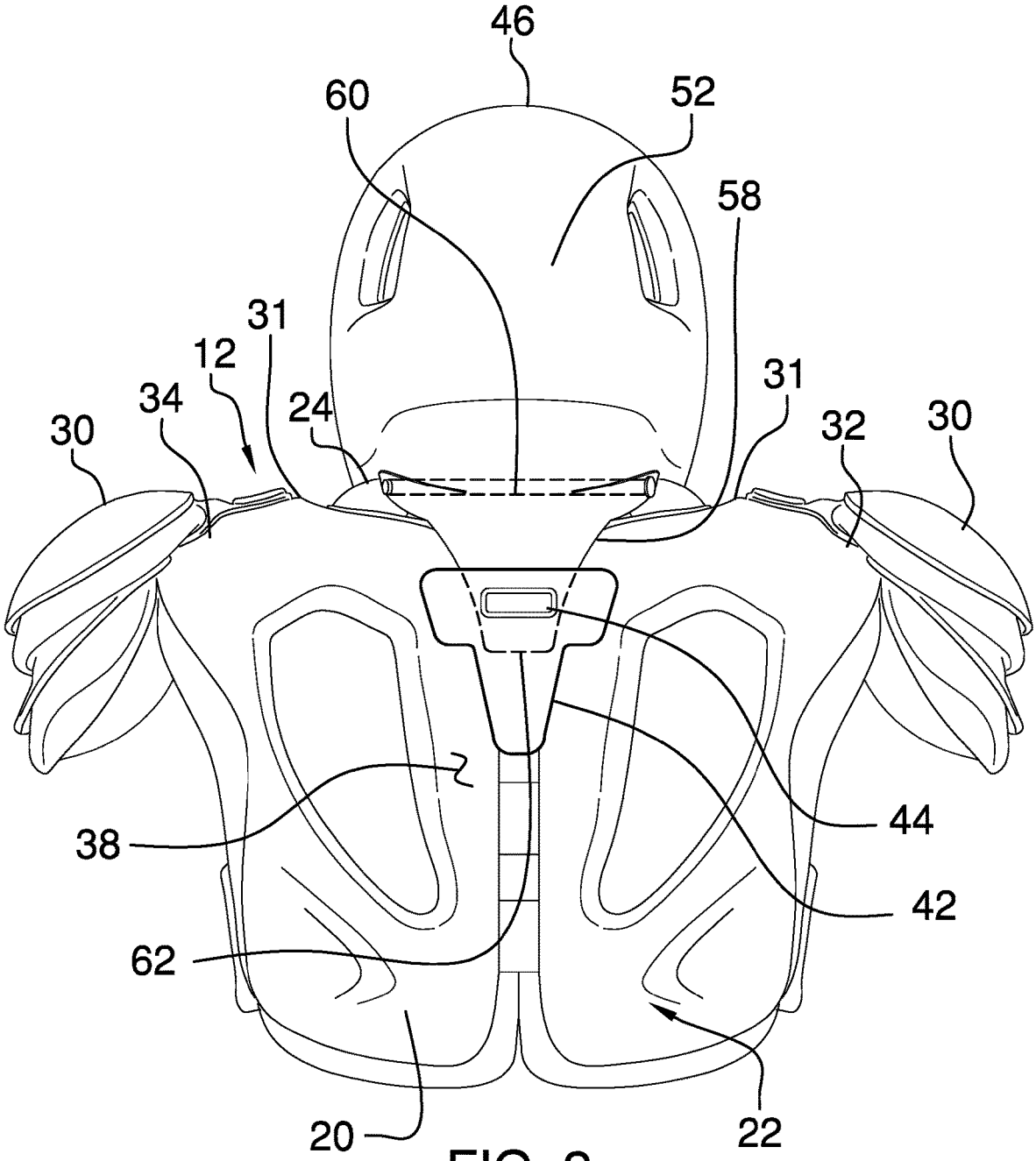
FIG. 2 is a back view of an embodiment of the disclosure.
Figure 3:
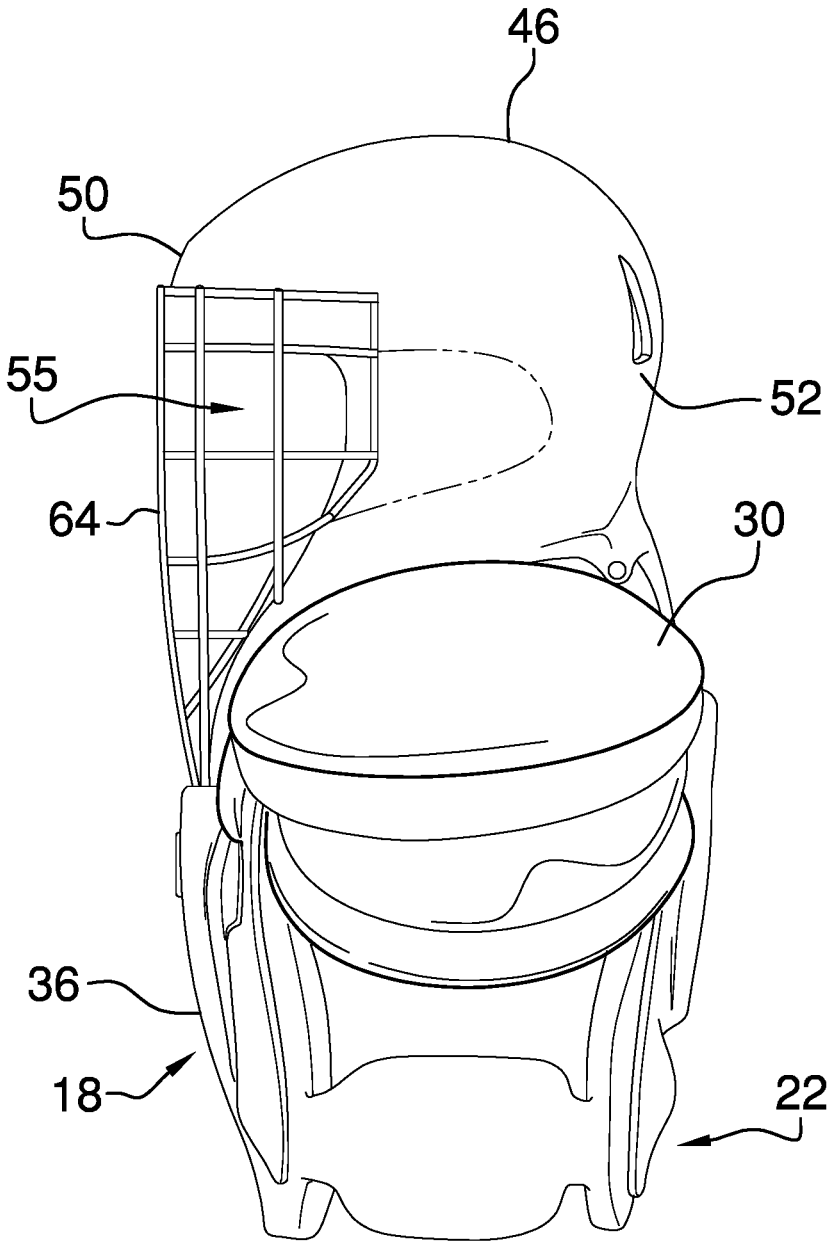
FIG. 3 is a left side view of an embodiment of the disclosure.
Figure 4:
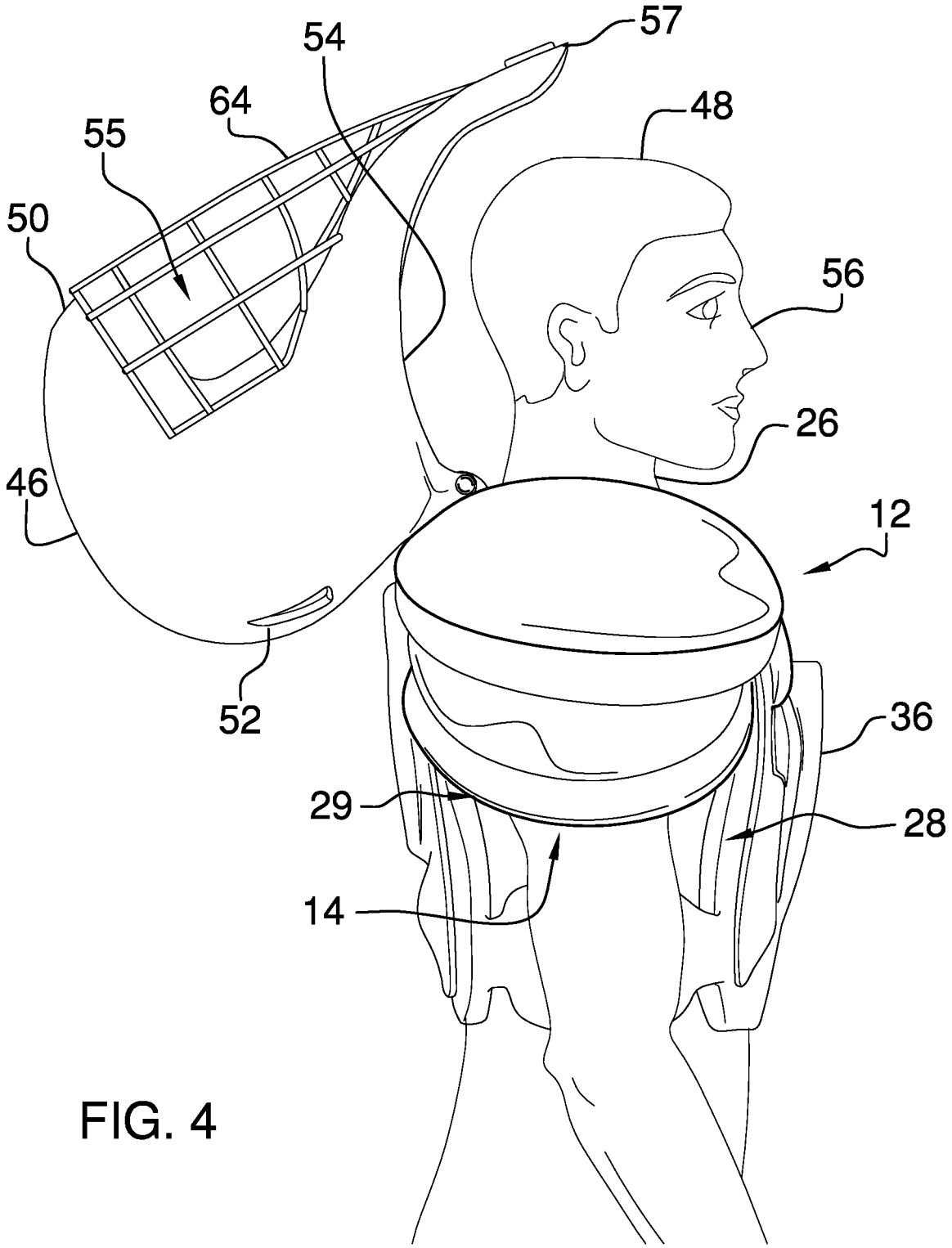
FIG. 4 is a perspective in-use view of an embodiment of the disclosure.

With reference now to the drawings, and in particular to FIGS. 1 through 4 thereof, a new helmet device embodying the principles and concepts of an embodiment of the disclosure and generally designated by the reference numeral 10 will be described.

As best illustrated in FIGS. 1 through 4, the helmet and shoulder pad assembly 10 generally comprises a pair of shoulder pads 12 that is wearable on a user's shoulders 14 during athletic activity to protect the user's shoulders 14 from impact energy. The pair of shoulder pads 12 has a front side 16 defining a chest plate 18 and the pair of shoulder pads 12 has a back side 20 defining a back plate 22. Additionally, the shoulder pads 12 have a neck opening 24 positioned at an intersection between the front side 16 and the back side 20 to receive the user's neck 26 having the chest plate 18 covering the user's chest 28 and having the back plate 22 covering the user's upper back 29.

The shoulder pads 12 include a pair of shoulder cups 30 that is each movably coupled to a junction 31 between the chest plate 18 and the back plate 22. Each of the shoulder cups 30 extends laterally away from a respective one of a first lateral side 32 and a second lateral side 34 of the junction 31 between the chest plate 18 and the back plate 22. In this way each of the shoulder cups 30 rests on top of a respective one of the user's shoulders 14. The shoulder pads 12 may be structured in the conventional manner of existing football shoulder pads 12.

A front engagement 36 is coupled to an outer surface 38 of the chest plate 18 and the front engagement 36 is centrally positioned on the chest plate 18. The front engagement 36 is spaced downwardly from the neck opening 24. The front engagement 36 may include a release mechanism 40 that can be manipulated by the user. A back engagement 42 is coupled to an outer surface 38 of the back plate 22 and the back engagement 42 is spaced centrally positioned in the back plate 22. The back engagement 42 is spaced downwardly from the neck opening 24 and the back engagement 42 may include a release mechanism 44 that can be manipulated by the user.

A helmet 46 is provided and the helmet 46 is hingedly coupled to the shoulder pads 12. The helmet 46 is positionable in a closed position to cover the user's head 48. Additionally, the helmet 46 is coupled to the shoulder pads 12 when the helmet 46 is positioned in the closed position thereby facilitating the helmet 46 to transfer impact energy into the shoulder pads 12. In this way the helmet 46 inhibits the user from suffering a concussion injury. The helmet 46 is positionable in an open position to expose the user's head 48.

The helmet 46 may have structural features that are common to football helmets approved for use in the National Football League and the National Collegiate Athletic Association. The helmet 46 has a forward side 50, a rear side 52 and a lower edge 54, and the forward side 50 has an opening 55 extending into an interior of the helmet 46 expose the user's face 56 thereby facilitating the user to see when the helmet 46 covers the user's head 48. The forward side 50 has a peninsula 57 extending downwardly therefrom. The peninsula 57 engages the front engagement 36 when the helmet 46 is positioned in the closed position for retaining the helmet 46 in the closed position.

A hinge 58 is hingedly coupled to the helmet 46 and the hinge 58 releasably engages the shoulder pads 12 for hingedly retaining the helmet 46 on the shoulder pads 12. The hinge 58 has an upper end 60 and a lower end 62, and the upper end 60 is hingedly coupled to the lower edge 54 of the helmet 46 at a point that is located on the rear side 52 of the helmet 46. The lower end 62 releasably engages the back engagement 42 thereby facilitating the helmet 46 to be removed from the shoulder pads 12. Each of the back engagement 42 and the front engagement 36 attach the helmet 46 to the shoulder pads 12 thereby facilitating impact energy absorbed by the helmet 46 to be transferred into the shoulder pads 12. A cage 64 is coupled to the helmet 46 and the cage 64 covers the user's face 56 when the helmet 46 is worn for protecting the user's face 56 from impact. The cage 64 is positioned on the forward side 50 of the helmet 46 and the cage 64 covers the opening 55 in the forward side 50.

In use, the shoulder pads 12 are worn on the user in the conventional manner of wearing shoulder pads 12. The helmet 46 is placed on the user's head 48 such that each of the hinge 58 and the peninsula 57 engages the respective back engagement 42 and the front engagement 36. In this way the helmet 46 is attached to the shoulder pads 12 for transferring impact energy absorbed by the helmet 46 into the shoulder pads 12. The peninsula 57 is releasable from the front engagement 36 to facilitate the helmet 46 to be hinged into the open position without disconnecting the hinge 58 from the back engagement 42. In this way the helmet 46 can be positioned between the closed position and the open position without uncoupling the hinge 58 from the back engagement 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A helmet and shoulder pad assembly for transferring impact on the helmet onto a user's shoulders for reducing the risk of concussion injuries, said assembly comprising:

a pair of shoulder pads being wearable on a user's shoulders during athletic activity wherein said shoulder pads are configured to protect the user's shoulders from impact energy;

a helmet being hingedly coupled to said shoulder pads, said helmet being positionable in a closed position wherein said helmet is configured to cover the user's head, said helmet being coupled to said shoulder pads when said helmet is positioned in said closed position thereby facilitating said helmet to transfer impact energy into said shoulder pads wherein said helmet is configured to inhibit the user from suffering a concussion injury, said helmet being positionable in an open position wherein said helmet is configured to expose the user's head; and wherein said pair of shoulder pads has a front side defining a chest plate, said shoulder pads having a back side defining a back plate, said shoulder pads having a neck opening being positioned at an intersection between said front side and said back side wherein said neck opening is configured to receive the user's neck having said chest plate covering the user's chest and having said back plate covering the user's upper back.

2. The assembly according to claim 1, wherein said shoulder pads includes a pair of shoulder cups each being movably coupled to a junction between said chest plate and said back plate, each of said shoulder cups extending laterally away from a respective one of a first lateral side and a second lateral side of said junction between said chest plate and said back plate wherein each of said shoulder cups is configured to rest on top of a respective one of the user's shoulders.

3. The assembly according to claim 1, further comprising a front engagement being coupled to an outer surface of said chest plate, said front engagement being centrally positioned on said chest plate, said front engagement being spaced downwardly from said neck opening.

4. The assembly according to claim 1, further comprising a back engagement being coupled to an outer surface of said back plate, said back engagement being spaced centrally positioned in said back plate, said back engagement being spaced downwardly from said neck opening.

5. The assembly according to claim 3, Wherein said helmet has a forward side, a rear side and a lower edge, said forward side having an opening extending into an interior of said helmet wherein said opening is configured to expose the user's face thereby facilitating the user to see when said helmet covers the user's head, said forward side having a peninsula extending downwardly therefrom, said peninsula engaging said front engagement when said helmet is positioned in said closed position for retaining said helmet in said closed position.

6. The assembly according to claim 4, wherein said assembly includes a hinge being hingedly coupled to said helmet, said hinge releasably engaging said shoulder pads for hingedly retaining said helmet on said shoulder pads, said hinge having an upper end and a lower end, said upper end being hingedly coupled to a lower edge of said helmet at a point being located on a rear side of said helmet, said lower end releasably engaging said back engagement thereby facilitating said helmet to be removed from said shoulder pads.

7. The assembly according to claim 5, further comprising a cage being coupled to said helmet wherein said cage is configured to cover the user's face when said helmet is worn for protecting the user's face from impact, said cage being positioned on said forward side of said helmet, said cage covering said opening in said forward side.

8. A helmet and shoulder pad assembly for transferring impact on the helmet onto a user's shoulders for reducing the risk of concussion injuries, said assembly comprising:

a pair of shoulder pads being wearable on a user's shoulders during athletic activity wherein said shoulder pads are configured to protect the user's shoulders from impact energy, said pair of shoulder pads having a front side defining a chest plate, said shoulder pads having a back side defining a back plate, said shoulder pads having a neck opening being positioned at an intersection between said front side and said back side wherein said neck opening is configured to receive the user's neck having said chest plate covering the user's chest and having said back plate covering the user's upper back, said shoulder pads including a pair of shoulder cups each being movably coupled to a junction between said chest plate and said back plate, each of said shoulder cups extending laterally away from a respective one of a first lateral side and a second lateral side of said junction between said chest plate and said back plate wherein each of said shoulder cups is configured to rest on top of a respective one of the user's shoulders;

a front engagement being coupled to an outer surface of said chest plate, said front engagement being centrally positioned on said chest plate, said front engagement being spaced downwardly from said neck opening;

a back engagement being coupled to an outer surface of said back plate, said back engagement being spaced centrally positioned in said back plate, said back engagement being spaced downwardly from said neck opening;

a helmet being hingedly coupled to said shoulder pads, said helmet being positionable in a closed position wherein said helmet is configured to cover the user's head, said helmet being coupled to said shoulder pads when said helmet is positioned in said closed position thereby facilitating said helmet to transfer impact energy into said shoulder pads wherein said helmet is configured to inhibit the user from suffering a concussion injury, said helmet being positionable in an open position wherein said helmet is configured to expose the user's head, said helmet has a forward side, a rear side and a lower edge, said forward side having an opening extending into an interior of said helmet wherein said opening is configured to expose the user's face thereby facilitating the user to see when said helmet covers the user's head, said forward side having a peninsula extending downwardly therefrom, said peninsula engaging said front engagement when said helmet is positioned in said closed position for retaining said helmet in said closed position;

a hinge being hingedly coupled to said helmet, said hinge releasably engaging said shoulder pads for hingedly retaining said helmet on said shoulder pads, said hinge having an upper end and a lower end, said upper end being hingedly coupled to said lower edge of said helmet at a point being located on said rear side of said helmet, said lower end releasably engaging said back engagement thereby facilitating said helmet to be removed from said shoulder pads; and a cage being coupled to said helmet wherein said cage is configured to cover the user's face when said helmet is worn for protecting the user's face from impact, said cage being positioned on said forward side of said helmet, said cage covering said opening in said forward side; said cage having a lower end extending downwardly from said helmet, said lower end of said cage releasably engaging said front engagement for retaining said helmet in said closed position.

* * * * *